United States Patent [19]

Kakizoe et al.

[11] Patent Number: 4,596,909

[45] Date of Patent: Jun. 24, 1986

[54] ELECTROMAGNETIC CONTACTOR

[75] Inventors: Masahiro Kakizoe; Shizutaka Nishizako, both of Aichi; Yuichi Wada, Hyogo; Teijiro Mori, Hyogo; Shigeru Masuda, Hyogo, all of Japan

[73] Assignee: Mitsubishi Denki Kabushiki Kaisha, Tokyo, Japan

[21] Appl. No.: 692,152

[22] Filed: Jan. 17, 1985

[30] Foreign Application Priority Data

Jan. 17, 1984 [JP] Japan ..... 59-3326[U]

[51] Int. Cl.[4] ..... H01H 33/10; H01H 9/36

[52] U.S. Cl. ..... 200/144 R; 200/147 R

[58] Field of Search ..... 200/144 R, 147 R, 147 B

[56] References Cited

U.S. PATENT DOCUMENTS

| | | | |
|---|---|---|---|
| 3,025,376 | 3/1962 | Yarrick | 200/144 R |
| 3,324,270 | 6/1967 | Lacan | 200/144 R |
| 4,429,198 | 1/1984 | Mori et al. | 200/144 R |

FOREIGN PATENT DOCUMENTS

| | | | |
|---|---|---|---|
| 1005153 | 3/1957 | Fed. Rep. of Germany | 200/144 R |
| 1051935 | 3/1959 | Fed. Rep. of Germany | 200/144 R |
| 1196750 | 7/1965 | Fed. Rep. of Germany | 200/144 R |
| 7327820 | 7/1973 | Fed. Rep. of Germany | 200/144 R |
| 486739 | 6/1938 | United Kingdom | 200/144 R |
| 2039148 | 7/1980 | United Kingdom | 200/144 R |
| 2078008 | 12/1981 | United Kingdom | 200/144 R |

*Primary Examiner*—Robert S. Macon

*Attorney, Agent, or Firm*—Sughrue, Mion, Zinn, Macpeak and Seas

[57] ABSTRACT

An electromagnetic contactor in which an arc extinguishing chamber is defined by an insulating base and a box attached removably to the insulating base. In the arc extinguish chamber, there are accommodated fixed contact elements having fixed contacts, a movable contact element having a movable contact adapted to be brought into and out of contact with the fixed contacts of the fixed contact elements, a commutation electrode for receiving arcs established when the movable contact comes out of contact with the fixed contacts, arc extinguish metal plates for extinguishing arcs commutated to the commutation electrode, and an extinguishing plate support for supporting the arc extinguishing plates. The extinguishing plate support is formed with a groove or hole for receiving the end portion of the commutation plate so that it is held on the commutation electrode. By elastically clamping the commutation electrode between the inner wall faces of the box defining the arc extinguishing chamber, the extinguishing plate support is held in the arc extinguishing chamber by the commutation electrode.

7 Claims, 6 Drawing Figures

ELECTROMAGNETIC CONTACTOR

BACKGROUND OF THE INVENTION

The present invention relates to an electromagnetic contactor and, more particularly, to a structure of an arc extinguishing chamber of an electromagnetic contactor.

With reference to FIGS. 1 to 3, there is shown an arc extinguishing chamber of an electromagnetic contactor previously proposed in the art.

Indicated at reference numeral 1 are two fixed contact elements which have fixed contacts 1*a* joined thereto. Indicated at reference numeral 2 is a movable contact element which has two movable contacts joined to the two ends thereof which come into and out of contact with the fixed contacts 1*a* to block an electric current. Indicated at reference numeral 3 is a cross bar which supports the movable contact element 2. Indicated at reference numeral 4 is an insulating base of an insulating substrate which supports the two fixed contact elements 1. Indicated at reference numeral 5 is a box of an insulating substance, which covers the fixed contact elements 1 and the movable contact element 2. Indicated at reference numeral 12 is an arc extinguishing chamber which is defined between the box 5 and the insulating base 4. The box 5 is constructed of a top 5*a*, two pairs of side walls 5*b* and 5*c*, and two pairs of protrusions 5*d* formed on the paired side walls 5*b* and facing each other.

Indicated at reference numeral 6 is a commutation electrode which is arranged in the box 5 above the movable contact element 2. This commutation electrode 6 is constructed of flat portions 6*a* arranged in parallel with the surfaces of the fixed contacts 1*a*, a pair of generally U-shaped portions 6*b* formed by extending portions of the flat portions 6*a*, to the vicinities of the movable contacts 2*a*, cut-away portions 6*c* formed by cutting away the generally U-shaped portions 6*b* at portions facing the movable contacts 2*a*, and protrusions 6*d* extending vertically from the leading ends of the flat portions 6*a*.

Indicated at reference numeral 7 are a plurality of arc extinguishing metal plates which are juxtaposed between the generally U-shaped portions 6*b* of the commutation electrode 6 and the fixed contact elements 1. These extinguishing metal plates 7 have elastic protrusions 7*a* at the two ends thereof. Indicated at reference numeral 8 are extinguishing plate supports which are made of an insulating substance. Each of these plate supports 8 is constructed of a pair of side walls 8*a*, a plurality of grooves 8*b* formed in the side walls 8*a* such that the protrusions 7*a* of the arc extinguishing metal plates 7 may be elastically deformed and press fitted thereinto, a through hole 8*c* formed therein to receive the corresponding one of the protrusions 6*d* of the commutation electrode 6, and a wall face 8*d* closing the sides of the grooves 8*b*. Indicated at reference numeral 9 is an elastic leaf spring which is retained in a recess 8*e* formed in the outer side face of one of the side walls 8*a* of the extinguishing plate supports 8.

Next, the method of assembling the electromagnetic contactor having the aforementioned construction will be explained.

The arc extinguishing metal plates 7 are elastically deformed and press fitted in the grooves 8*b* of the extinguishing plate supports 8 up to the wall faces 8*d* of the grooves 8*b* so that they are fixed in the extinguishing plate supports 8. The protrusions 6*d* of the commutation electrode 6 are inserted into the through holes 8*c* of the extinguishing plate supports 8 and are then folded so that the commutation electrode 6 is fixed on the two extinguishing plate supports 8. When the resultant temporary assembly is fitted in the box 5, the leaf springs 9 are elastically deformed between the side walls 8*a* of the extinguishing plate supports 8 and the paired side walls 5*b* and 5*b*, respectively, of the box 5 to retain the extinguishing plate supports 8.

These extinguishing plate supports 8 are retained in the box 5 at the top 5*a*, the side walls 5*b* and 5*c*, and the protrusions 5*d* of the box 5. Moreover, the protrusions 5*d* abut against the two end faces of the arc extinguishing metal plates 7 to prevent these metal plates 7 from coming out from their supports 8. With the box 5 being fastened to the insulating base 4 by means of screws (not shown), the extinguishing plate supports 8 are in abutment with the insulating base 4 or the fixed contact elements 1 so that the extinguishing plate supports 8 are retained in the box 5. When the box 5 is removed for replacement of the contacts from the insulating base so that the arc extinguish chamber 12 is opened, as has been described above, the extinguishing plate supports 8 and the commutation electrode 6 in the electromagnetic contactor are retained by the elastic deformation of the leaf springs 9 so that they are prevented from coming out from the box 5. In the normal state in which the box 5 is fastened to the insulating base 4, on the other hand, the extinguishing plate supports 8 and the commutation electrode 6 are retained by the box 5 and the insulating base 4 or the fixed contact elements 1 so that they are fixed with an external force.

Thus, the electromagnetic contactor of the prior art has defects in that it requires the provision of the leaf springs 9 and it requires that the commutation electrode 6 be separately mounted, making the manufacturing costs thereof relatively high.

SUMMARY OF THE INVENTION

An object of the present invention is to provide an electromagnetic contactor for extending an arc established between contacts to a space at a predetermined distance from the contacts to block that arc, in which the arc extinguish parts can easily be assembled and an inexpensive structure can be used for an arc extinguishing chamber by omitting the leaf springs and the fixing function of the commutation electrode.

The above-specified objects of the present invention can be achieved by a structure in which a commutation electrode disposed in an arc extinguishing chamber is elastically held between the inner wall faces of the arc extinguishing chamber and in which extinguishing plate supports are supported on the commutation electrode by inserting the end portions of the commutation electrode in groove or holes formed in the extinguishing plate supports.

DESCRIPTION OF THE PREFERRED EMBODIMENTS

Figure 1:
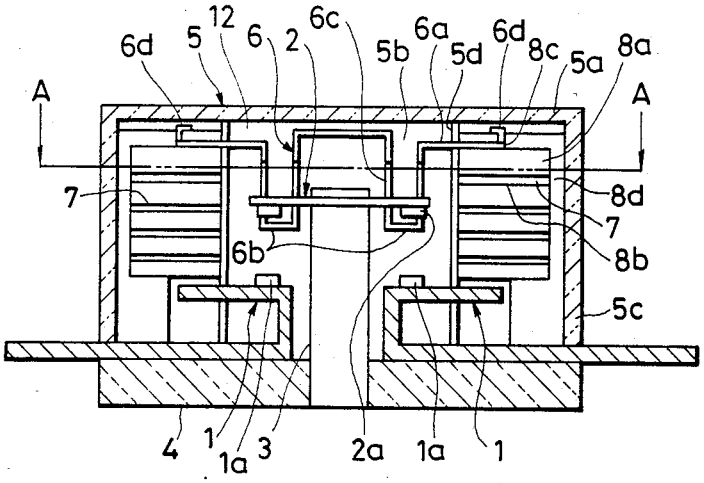
FIG. 1 PRIOR ART
FIG. 1 is a longitudinal cross-sectional view showing the arc extinguishing chamber portion of an electromagnetic contactor of the prior art.
Figure 2:
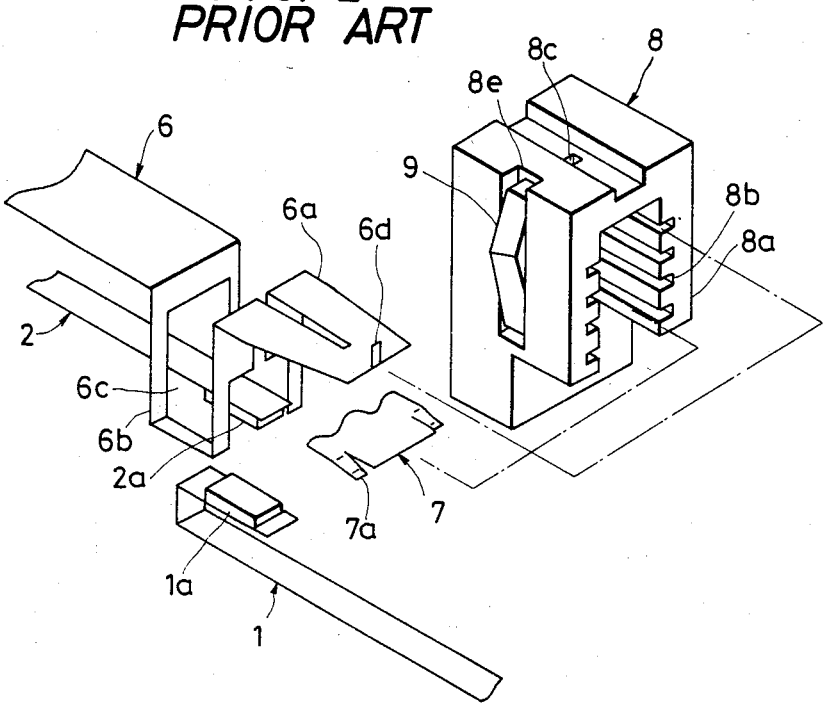
FIG. 2 PRIOR ART
FIG. 2 is an exploded perspective view showing essential portions of the contactor of FIG. 1.
Figure 3:
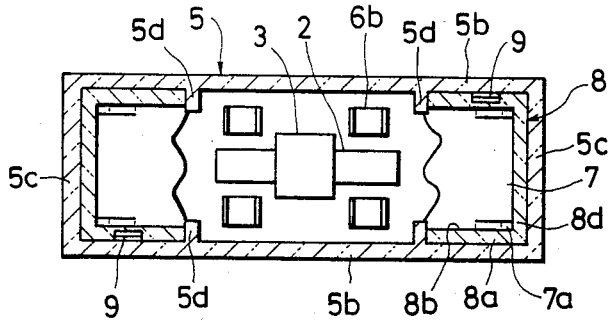
FIG. 3 PRIOR ART
FIG. 3 is a cross-sectional view taken along line A—A of FIG. 1.

The present invention will be described in connection with preferred embodiments thereof with reference to FIGS. 4 to 6. The same reference numerals appearing therein indicate the same or corresponding portions as those shown in FIGS. 1 to 3, and their repeated explanations are omitted.

Figure 4:
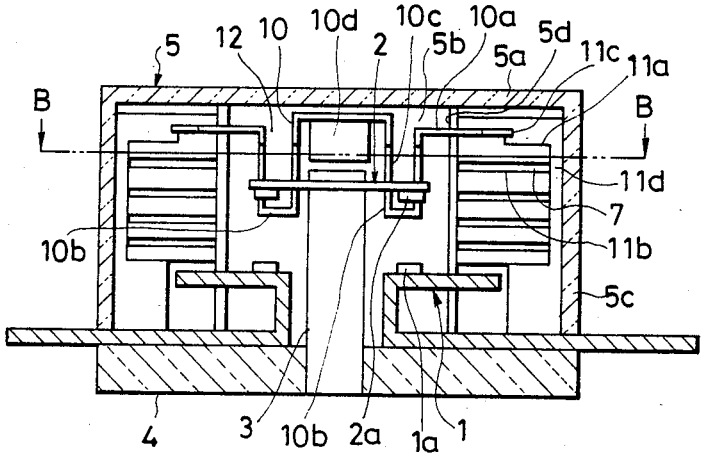
FIG. 4 is a longitudinal section showing the same portion of an electromagnetic contactor according to the present invention as that shown in FIG. 1.
Figure 5:
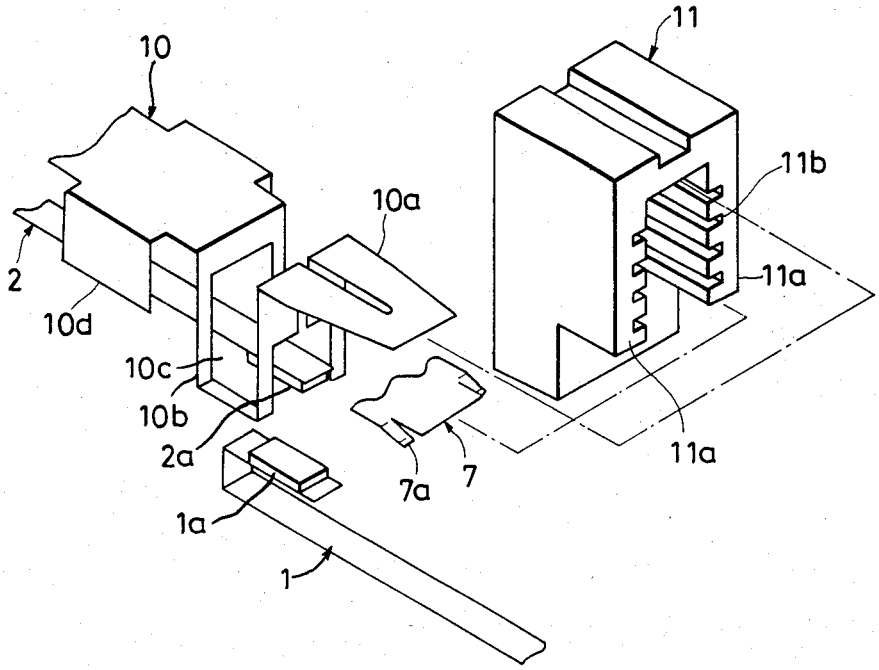
FIG. 5 is an exploded perspective view showing essential portions of the contactor of FIG. 4.
Figure 6:
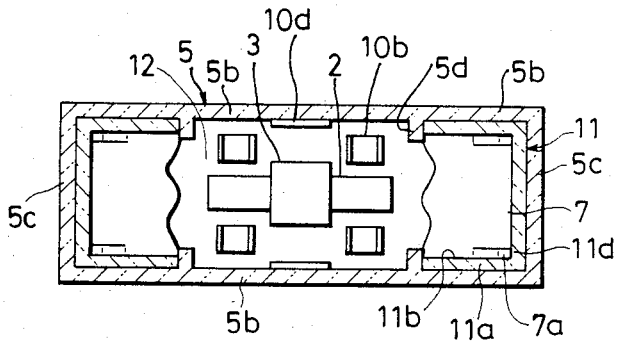
FIG. 6 is a cross-sectional view taken along a line B—B in FIG. 4.

In FIGS. 4 to 6, reference numeral 10 indicates a commutation electrode which is arranged in the box 5 above the movable contact elements 2. This commutation electrode 10 is constructed of flat portions 10*a* arranged parallel to the surfaces of the fixed contacts 1*a*, a pair of generally U-shaped portions formed by extending portions of the flat portions 10*a* to the vicinities of the movable contacts 2*a*, cut-away portions 10*c* formed by cutting away the generally U-shaped portions 10*b* at portions facing the movable contacts 2*a*, and an inverted U-shaped portion 10*d* of inverted U-shaped longitudinal section formed between the paired generally U-shaped portions 10*b* and press fitted elastically between the paired side walls 5*b* of the box 5. Indicated at reference numeral 11 are extinguishing plate supports which are made of an insulating substance. Each of these plate supports 11 is constructed of a pair of side walls 11*a*, grooves 11*b* formed in the side walls 11*a* for elastically deforming and press fitting thereinto the protrusions 7*a* formed at the end portions of the arc extinguishing metal plates 7, a groove 11*c* for receiving the leading end of the corresponding one of the flat portions 10*a* of the commutation electrode 10, and a wall face lid closing the sides of the grooves 11*b*. Reference numeral 12 indicates an arc extinguishing chamber.

In the electromagnetic contactor having the construction thus far described, according to the present invention, the arc extinguishing metal plates 7 are press fitted in the extinguishing plate supports 8, and the inverted U-shaped portion 10*d* of the commutation electrode 10 is elastically deformed and press fitted in the box 5 while the leading ends of the flat portions 10*a* of the commutation electrode 10 are inserted into the grooves 11*c* of the extinguishing plate supports 8. As a result, the inverted U-shaped portion 10*d* is elastically held from both sides by the side walls 5*b* of the box 5 so that the extinguishing plate supports 8 are retained and prevented from coming out from the box 5. With the box 5 being fastened to the insulating base 4, the extinguishing plate supports 8, the commutation electrode 10 and the arc extinguish metal plates 7 are fixed, similar to the structure of the prior art of FIGS. 1 to 3, by the box 5 and the insulating base 4 or the fixed contact elements 1 so that they cannot be moved by an external force.

In the embodiment thus far described, the electromagnetic contactor is constructed such that the inverted U-shaped portion 10*d* formed at the center of the commutation electrode 10 is elastically fitted in the box 5. However, the structure need not be limited to the inverted U-shaped portion 10*d* of the aforementioned embodiment. In short, the longitudinal section of the portion to be held by the box 5 need not always be of the inverted U-shape and it is sufficient for the width of the portion retaining the commutation electrode 10 to be made slightly larger than the spacing between the paired facing side walls 5*c* of the box 5 so that the retaining portion may be elastically narrowed and press fitted between the side walls 5*c* of the box 5.

As has been described hereinbefore, according to the present invention, the generally U-shaped portion of the commutation electrode is elastically deformed, press fitted and held in the box forming the arc extinguishing chamber so that the extinguishing plate supports are retained by the leading ends of the flat portions of the commutation electrode. As a result, the leaf springs for fixing the extinguishing plate supports can be dispensed with and the separate step of fixing the commutation electrode can be omitted. Thus, the arc extinguish chamber of the invention can be formed inexpensively, whereby the electromagnetic contactor can be provided at a reasonable cost.

We claim:

1. In an electromagnetic contactor comprising:

an insulating base made of an insulating substance;

a box made of an insulating substance and attached removably to said insulating base for defining an arc extinguishing chamber between itself and said insulating base when attached thereto;

fixed contact elements disposed in said arc extinguishing chamber and having fixed contacts;

a movable contact element disposed in said arc extinguishing chamber and having a movable contact which can be moved into and out of contact with said fixed contacts;

a commutation electrode disposed in said arc extinguishing chamber for commutating an arc established between said fixed contacts and said movable contact when said fixed and movable contacts are moving out of contact with each other;

a plurality of arc extinguishing metal plates disposed in said arc extinguishing chamber for extinguishing arcs commutated to said commutation electrode; and an extinguishing plate support made of an insulating substance and having a plurality of grooves or holes for receiving and supporting said arc extinguishing metal plates, the improvement wherein: said extinguishing plate support is formed with a groove or a hole for receiving an end portion of said commutation electrode so that said extinguishing plate support is supported by said commutation electrode; and said commutation electrode is made of an elastic plate and being elastically clamped between inner wall faces of said box to be held in said box.

2. The electromagnetic contactor according to claim 1, wherein said arc extinguishing chamber is provided at both sides thereof with extinguishing plate supports extending across said commutation electrode, and wherein said commutation electrode has both end portions fitted in said grooves or holes of said extinguishing plate supports and its central portion held in said box.

3. The electromagnetic contactor according to claim 2, wherein said commutation electrode comprises: flat portions extending from both end portions thereof parallel to surfaces of said fixed contact elements for fitting in said grooves or holes of said extinguish plate supports; and U-shaped portions merging at upper ends into said flat portions and bent into a U shape in the vicinity of said movable contact.

4. The electromagnetic contactor according to claim 3, wherein said movable contact element has movable contacts at both its end portions, and wherein said commutation electrode has two respective U-shaped portions positioned in the vicinities of said two movable contacts.

5. The electromagnetic contactor according to claim 3, wherein said arc extinguishing metal plates are interposed between said flat portions of said commutation electrode and said fixed contact elements and extend parallel to said flat portions.

6. The electromagnetic contactor according to claim 2, wherein said commutation electrode has a central portion formed with a generally U-shaped longitudinal section and is clamped between inner wall faces of said box.

7. The electromagnetic contactor according to claim 2, wherein said extinguishing plate supports have first side faces formed with grooves or holes for receiving said commutation electrode and grooves or holes for receiving said arc extinguishing plates and second side faces closed by said side wall.

* * * * *